US005314122A

United States Patent [19]

Winter

[11] Patent Number: 5,314,122

[45] Date of Patent: May 24, 1994

[54] FUEL INJECTION VALVE

[75] Inventor: Martin F. Winter, Stuttgart, Fed. Rep. of Germany

[73] Assignee: Robert Bosch GmbH, Stuttgart, Fed. Rep. of Germany

[21] Appl. No.: 109,035

[22] Filed: Aug. 19, 1993

[30] Foreign Application Priority Data

Nov. 20, 1992 [DE] Fed. Rep. of Germany ..... 4239110

[51] Int. Cl.[5] ..... F02M 61/18; F02M 51/08; F02M 69/04

[52] U.S. Cl. ..... 239/585.1; 239/585.4; 239/900

[58] Field of Search ..... 239/585.1-585.5, 239/533.12, 900

[56] References Cited

U.S. PATENT DOCUMENTS 4,057,190 11/1977 Kiwior et al. ..... 239/533.12
4,395,988 8/1983 Knapp et al. ..... 239/585.3
4,434,765 3/1984 Eshelman ..... 239/585.1

FOREIGN PATENT DOCUMENTS 0063952 4/1982 European Pat. Off. ..... 239/900
3411331 7/1985 Fed. Rep. of Germany .
3939093 5/1991 Fed. Rep. of Germany .
59-70871 4/1984 Japan .

*Primary Examiner*—Andres Kashnikow
*Assistant Examiner*—Karen B. Merritt
*Attorney, Agent, or Firm*—Edwin E. Greigg; Ronald E. Greigg

[57] ABSTRACT

Fuel injection valves have swirl-generating configurations in order to atomize the fuel as it passes through a narrow flow opening. The fuel injection valve of the invention includes a conduit segment leading to a cylindrical injection conduit. The conduit segment includes a conical widening section and, in the region of a wall of the conical widening section, a highly unstable separation zone is created as fuel passes through it. This zone builds up and collapses again periodically with relatively high frequency so that turbulence created along the wall of the ensuing injection conduit causes the stream surface to break down early as the fuel leaves an injection port; as a result, the stream has fine fuel droplets and nevertheless has a defined stream pattern so that properly aimed injection is made possible. The invention is intended in particular for fuel injection systems for internal combustion engines.

2 Claims, 2 Drawing Sheets

FUEL INJECTION VALVE

BACKGROUND OF THE INVENTION

The invention is based on a fuel injection valve for a mixture compressing internal combustion engine.

A fuel injection valve is already known (German Offenlegungsschrift 39 39 093), in which swirl-generating means are provided in order to atomize the fuel as it passes through a narrow flow opening. This has the disadvantage, however, that the strong centrifugal forces acting upon the fuel cause an undesirably pronounced flaring of the stream. In addition, the high frictional resistance upon passage to the narrow flow opening makes the fuel stream pattern even more nonuniform. With this arrangement, injection that is as properly aimed as possible and is finely atomized, which is a prerequisite for optimal fuel combustion, cannot yet be assured with satisfaction.

OBJECT AND SUMMARY OF THE INVENTION

The fuel injection valve of the invention has the advantage over the prior art that very good fuel preparation is made possible, with a conical stream that is not excessively flared, yet the fuel is nevertheless finely atomized. In particular, an early breakdown of the stream into small droplets can be achieved without requiring any swirl-generating means.

It is especially advantageous that the fuel flows through only relatively wide cross sections, so that virtually no friction losses are brought about.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
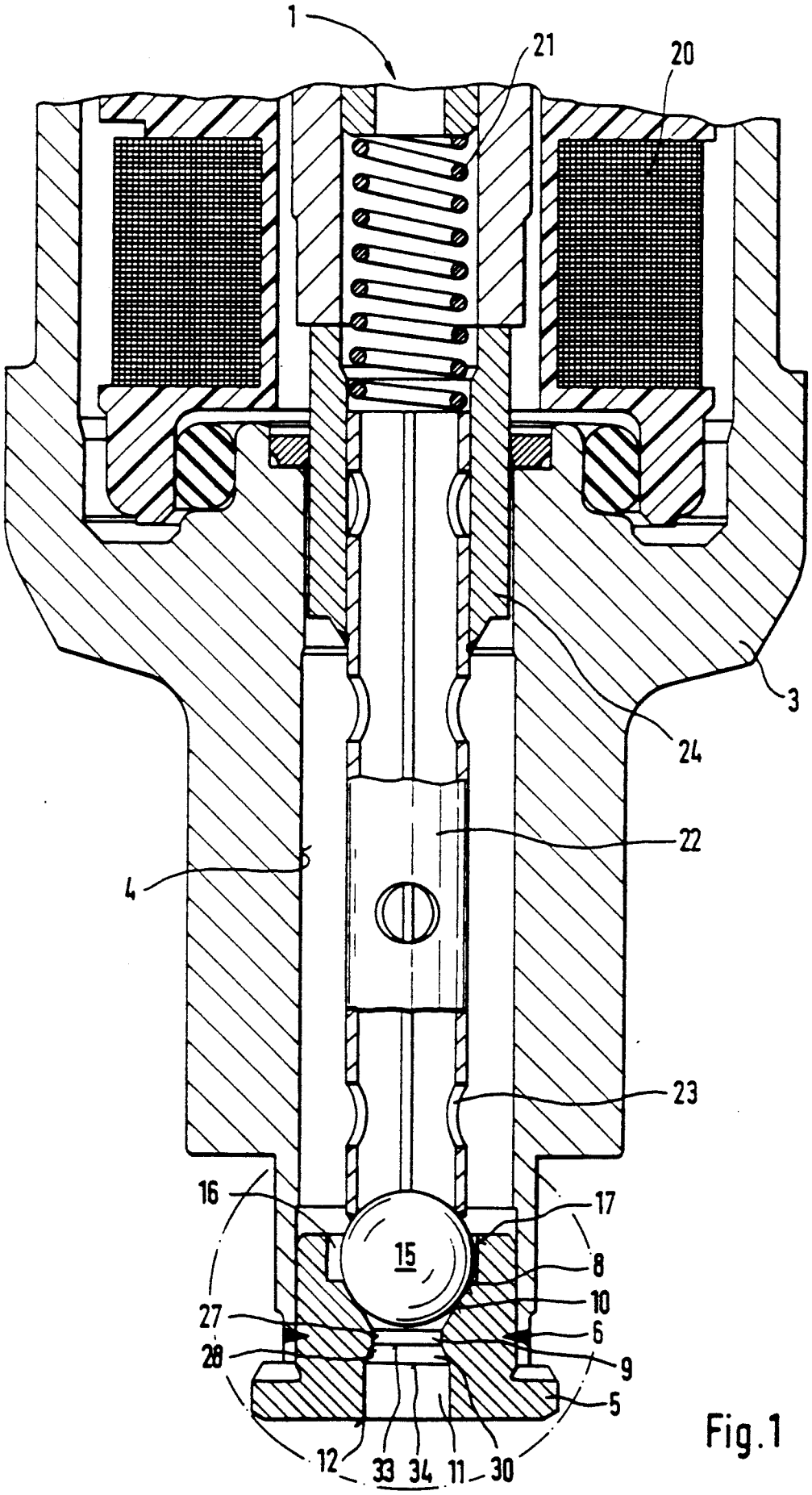
FIG. 1 shows a section through a fuel injection valve of the invention.
Figure 2:
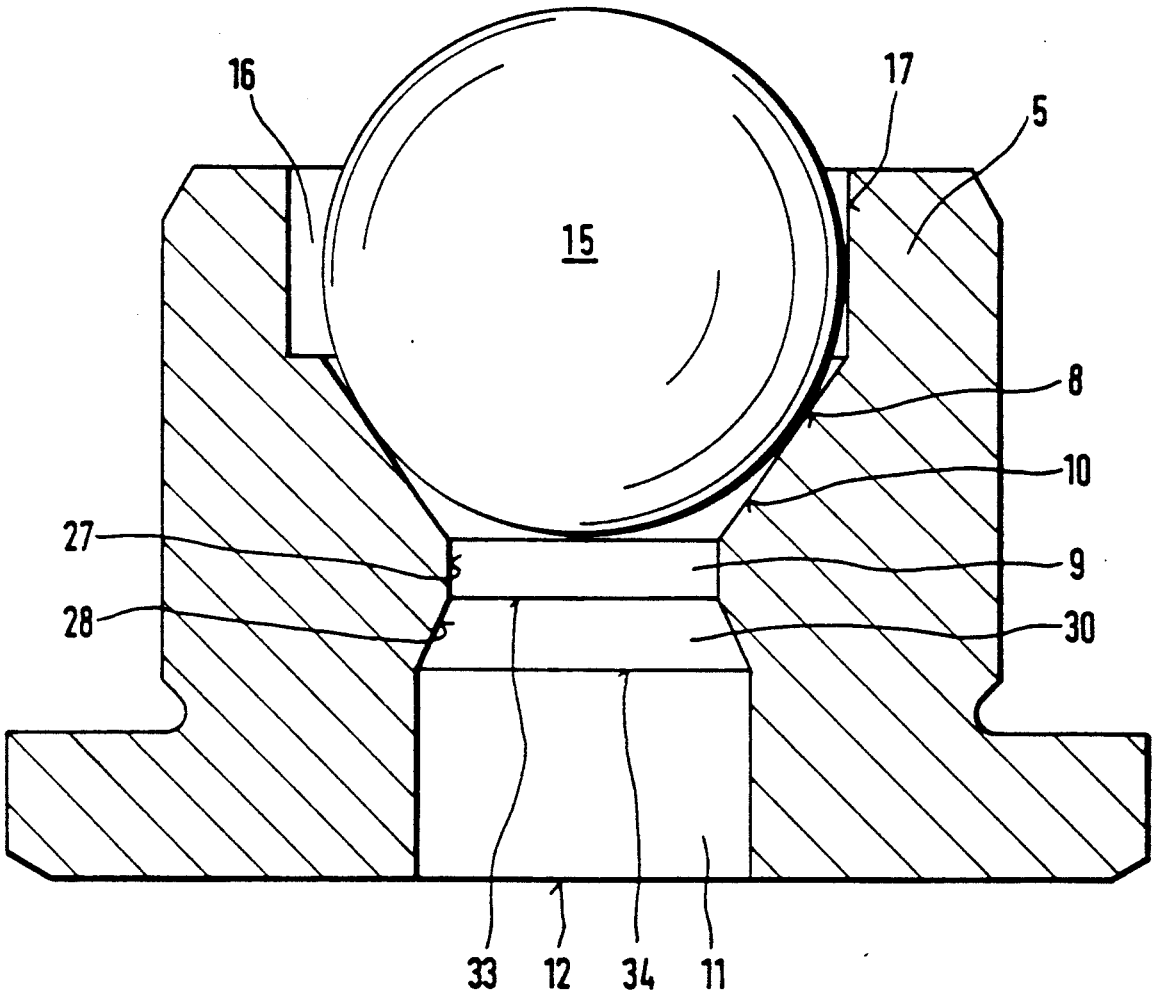
FIG. 2 shows the exemplary embodiment in an enlarged detail of FIG. 1 outlined by dot-dash lines in FIG. 1.

The fuel injection valve 1 shown in FIG. 1 for a fuel injection system, for instance for a mixture-compressing internal combustion engine with externally supplied ignition, has a valve housing 3 with a through opening 4, in which a valve seat body is secured, for instance by means of a welded connection 6.

Protruding into the through opening 4 is a tubular valve closing member 22, in whose wall radial openings 23 are provided. A compression spring 21 acts upon the valve closing member 22 in the closing direction, and the valve closing member has a valve closing body 15, for instance in the form of a hardened ball, which is guided in the valve seat body 5, for instance in a borelike guide cylinder 17. In order to open the fuel injection valve 1, an electric circuit, not shown, of a magnet coil 20 is closed. The magnetic forces that then become operative attract a soft-magnetic armature 24 that is connected to the valve closing member 22. Jointly with the armature 24, the valve closing member 22 is moved in the opening direction away from its contact with a sealing seat 8 in the valve seat body 5.

The fuel supplied flows through the valve closing member 22 and its radial openings 23 via at least one axial groove 16 into the borelike guide cylinder 17 in the valve seat body 5 to the sealing seat 8. Downstream of the sealing seat 8, the fuel enters a conical tapered portion 10 in the valve seat body 5 and from there enters a cylindrical conduit segment 9 in the valve seat body 5. The conduit segment 9 forms the smallest cross section for the fuel flow. The conduit segment 9 is adjoined by a conical widening section 30, increasing in size in the flow direction, in the valve seat body 5. In the plane of contact with the conduit segment 9, a smallest opening 33 of the conical widening section 30 is formed. The axial length of the conduit segment 9 should amount to at least 10% of the opening diameter of the smallest opening 33 of the conical widening section 30, to enable calming the fuel flow after it flows through the conical taper 10, so that after the fuel leaves this calming segment, a markedly parallel flow prevails. Depending on the use of the fuel injection valve 1, greater axial length of the conduit segment 9 may be selected, in order to further improve the pattern of the fuel stream.

On its downstream end, the conical widening section 30 has a largest opening 34 and discharges into a cylindrical injection conduit 11 in the valve seat body 5. The conduit segment 9 has a wall 27, and the conical widening section 30 has a wall 28. Via an injection port 12 of the injection conduit 11, the fuel leaves the valve seat body 5 of the fuel injection valve 1. In embodying the conical widening section 30, care should be taken that the opening diameter of the largest openings 34 of the conical widening section 30 have an opening diameter that is larger by at least 10% and at most 50% than the smallest opening 33 of the conical widening section 30. The opening angle of the conical widening section 30, formed by the wall 28 of the conical widening section 30 and the center axis of the conduit segment 9, should amount to at least 20° and at most 30°.

Adjoining the wall 27 of the conduit segment 9, in the region of the wall 28 of the conical widening section 30, a highly unstable separation zone is created when there is a flow of fuel through it, and this zone builds up and fades again periodically at relatively high frequency; in other words, flow vortices are created, which collapse and are recreated again and again. With the aforementioned range of the opening angle of the conical widening section 30, this also leads to a definedly unstable flow state in the fuel stream along the wall of the injection conduit 11. The disturbed unstable flow region at the circumference of the fuel stream along the wall of the injection conduit 11 imposes its properties on the stable region of the fuel stream in its interior, as a result of equalization flows caused by transverse flow components and as a result of internal frictional factors. These compensation flows and internal frictional factors cause turbulence in the inner flow region of the fuel stream, which causes early breakdown of the surface of the stream as the stream leaves the outlet opening 12, and as a result the fuel stream is atomized into fine droplets, yet nevertheless a narrowly defined fuel stream pattern is maintained, enabling properly aimed injection.

The axial length, which is composed of the axial length of the conical widening section 30 and the axial length of the adjoining injection conduit 11, must be selected such that the separation zone of the fuel flow ends upstream of the injection port 12 of the injection conduit 11. To assure this, the axial length of the conical widening section 30 and the axial length of the adjoining injection conduit 11 must amount to at least 60% and at most 180% of the diameter of the smallest opening 33 of the conical widening section 30.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A fuel injection valve having a valve housing, a valve seat body with a sealing seat, with which a valve closing member cooperates, wherein a conical taper is located downstream of the sealing seat and fuel is injected by means of a cylindrical injection conduit, the conical taper (10) is adjoined by a cylindrical conduit segment (9), at which a conical widening section (30) having a smallest opening (33) begins, and said conical widening section (30) merges at a largest opening (34) with the injection conduit (11), wherein the opening diameter of the largest opening (34) of the conical widening section (30) is larger than the opening diameter of the smallest opening (33) of the conical widening section (30) by at least 10% and at most 50% of the opening diameter of the smallest opening (33), and the opening angle of a wall (28) of the conical widening section (30) relative to a center axis of the conduit segment (9) amounts to from 20° to 30°, and the sum of the axial length of the conical widening section (30) and the axial length of the injection conduit (11) is at least 60% and at most 180% of the opening diameter of the smallest opening (33) of the conical widening section (30).

2. A fuel injection valve as defined by claim 1, in which the axial length of the cylindrical conduit segment (9) amounts to at least 10% of the opening diameter of the smallest opening (33) of the conical widening section (30).

* * * * *